US011369241B2

(12) United States Patent
Stoddard et al.

(10) Patent No.: US 11,369,241 B2
(45) Date of Patent: Jun. 28, 2022

(54) CLEANING SYSTEM USING DUAL BRUSH VACUUM AND SWEEP HEAD

(71) Applicant: Minuteman International, Inc., Pingree Grove, IL (US)

(72) Inventors: Jeremy C. Stoddard, Holland, MI (US); Steven J. Leibrandt, Norton Shores, MI (US); Brent A. Caudill, Holland, MI (US); John M. Hill, Naperville, IL (US)

(73) Assignee: Minuteman International, Inc., Pingree Grove, IL (US)

( * ) Notice: Subject to any disclaimer, the term of this patent is extended or adjusted under 35 U.S.C. 154(b) by 418 days.

(21) Appl. No.: 16/665,972

(22) Filed: Oct. 28, 2019

(65) Prior Publication Data

US 2020/0129020 A1 Apr. 30, 2020

Related U.S. Application Data

(60) Provisional application No. 62/751,663, filed on Oct. 28, 2018.

(51) Int. Cl.

| | |
|---|---|
| ***A47L 7/02*** | (2006.01) |
| ***A47L 9/00*** | (2006.01) |
| ***A47L 11/24*** | (2006.01) |
| ***A47L 11/40*** | (2006.01) |

(Continued)

(52) U.S. Cl.

CPC ..... *A47L 7/02* (2013.01); *A47L 9/009* (2013.01); *A47L 9/0411* (2013.01); *A47L 9/0472* (2013.01); *A47L 11/24* (2013.01); *A47L 11/4038* (2013.01); *A47L 11/4044* (2013.01);

(Continued)

(58) Field of Classification Search

CPC ..... A47L 7/02; A47L 9/009; A47L 9/0411; A47L 9/0472; A47L 11/24; A47L 11/4038; A47L 11/4044; A47L 9/1427; A47L 11/4069; A47L 11/4041

See application file for complete search history.

(56) References Cited

U.S. PATENT DOCUMENTS 3,006,021 A * 10/1961 Patch ..... E01H 1/0854 15/349
3,409,933 A * 11/1968 Larsson ..... A47L 11/4058 15/384

(Continued)

FOREIGN PATENT DOCUMENTS

WO WO-2006121783 A1 * 11/2006 ..... A47L 11/24
WO WO-2010043406 A1 * 4/2010 ..... B03C 3/017

*Primary Examiner* — David Redding
(74) *Attorney, Agent, or Firm* — Frank M. Scutch, III

(57) ABSTRACT

A sweeper/vacuum ride-on cleaning system includes a vacuum and sweeping mechanism using a sweeper brush and vacuum brush in one cleaning head. A caster leveling system is used for setting the level of the head above the floor. A single motor drive system using a two-sided belt is used for driving the sweeper brush and vacuum brush. A dust management system using holes adjacent to a debris try for holding debris in the tray. A pivoting door access assembly is used for allowing the sweeper brush and vacuum brush to be accessed and removed from the side of the cleaning head. Finally, a bag cage with holes throughout each of its supporting surfaces is used for holding the vacuum bag and allowing air to escape from all sides of the bag to increase vacuum efficiency.

19 Claims, 14 Drawing Sheets

(51) Int. Cl.
*A47L 9/04* (2006.01)
*A47L 9/14* (2006.01)

(52) U.S. Cl.
CPC ..... *A47L 9/1427* (2013.01); *A47L 11/4069* (2013.01)

(56) References Cited

U.S. PATENT DOCUMENTS 4,624,026 A * 11/1986 Olson ..... E01H 1/106 15/83
5,295,277 A * 3/1994 Koenigs ..... E01H 1/0854 15/83
5,409,512 A * 4/1995 Wilkerson ..... B01D 46/71 15/340.1
6,421,870 B1 * 7/2002 Basham ..... E01H 1/0854 15/83
2004/0045111 A1 * 3/2004 Engel ..... E01H 1/0854 15/84
2013/0247938 A1 * 9/2013 Walz ..... A47L 11/4011 15/3

* cited by examiner

CLEANING SYSTEM USING DUAL BRUSH VACUUM AND SWEEP HEAD

FIELD OF THE INVENTION

The present invention relates generally to commercial floor care and more particularly to vacuum systems used in commercial floor care equipment.

BACKGROUND

Rider or "Ride-on" floor cleaning systems are well known in the art and are often used for cleaning floors with large surface areas. Often these ride-on systems include either a sweeper or a vacuum system. The sweeper sweeps or pushes the dirt or debris to some predetermined location while a vacuum system merely vacuums up the dirt and debris with its vacuum motor. The problem with these systems is that they often are not effective against all kinds of dirt and debris. Some ride-on systems have a vacuum that works well for dirt and particulate matter while others work well for sweeping larger debris out of the path of the ride-on. Consequently, new solutions are necessary to provide a system to remove dirt and debris of all sizes in commercial floor care situations.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
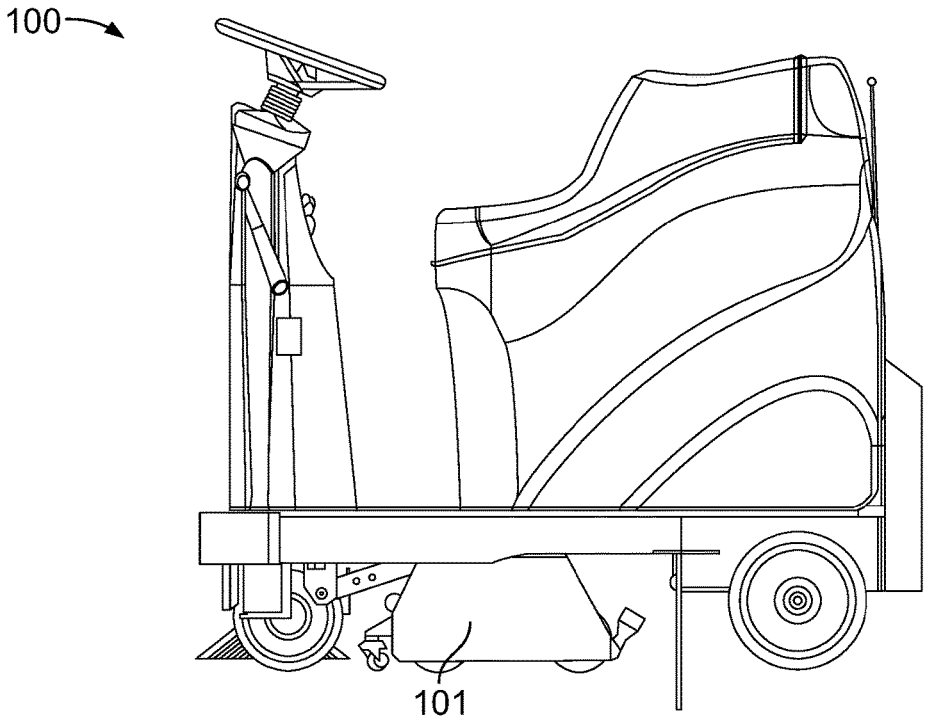
FIG. 1 illustrates a ride-on commercial vacuum/sweeper system according to various embodiments of the invention

Before describing in detail embodiments that are in accordance with the present invention, it should be observed that the embodiments reside primarily in combinations of method steps and apparatus components related to a cleaning system using a dual-brushes having both vacuum and sweep in one head. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

1. Vacuum and Sweep in One Cleaning Head

FIG. 1 illustrates a ride-on commercial vacuum system according to various embodiments of the invention. The vacuum system 100 in FIG. 1 includes, amongst other things, a single cleaning head 101 having the sweep brush and vacuum system both configured into one housing.

FIG. 2A, FIG. 2B, FIG. 2C, FIG. 2D, FIG. 2E and FIG. 2F illustrate an embodiment of a vacuum and sweeper brush both configured into one cleaning head. As seen in this embodiment, the head 200 may be attached to a ride-on commercial vacuum system. The head 200 includes a housing 201 having a dome-like shape that uses a sweeper style front brush 202 having a first diameter that aids the head to pick up larger debris on the floor or carpet. The rotating motion of the front brush 202 allows the larger debris to be routed over top of the front brush 202 into a debris tray 204.

Similarly, a second brush 205, having a second diameter, is used to direct dust, dirt and/or imbedded debris not caught by the sweeper system, into a vacuum system that uses a vacuum bag. The first brush 202 and second brush 205 although different in size are typically substantially cylindrical in shape and having brush length(s) as needed. The front brush 202 uses a debris guide skirt 203 to direct the larger debris the top of the front brush 202. Dust, dirt and embedded debris on the floor is further agitated by the rear brush 205 where it is directed to a vacuum nozzle or shoe 207 that is oriented close to the floor for capturing the maximum amount of dust and debris. In the embodiment shown in FIGS. 2A through 2F, the front brush 201 is larger in diameter than the rear brush 205. By way of example and not limitation, the first or front brush 202 might be 6-inches in diameter while the second or rear brush 205 may be 4-inches in diameter. Both the front brush 201 and rear brush 205 are configured under the dome-like housing 201.

Figure 2A:
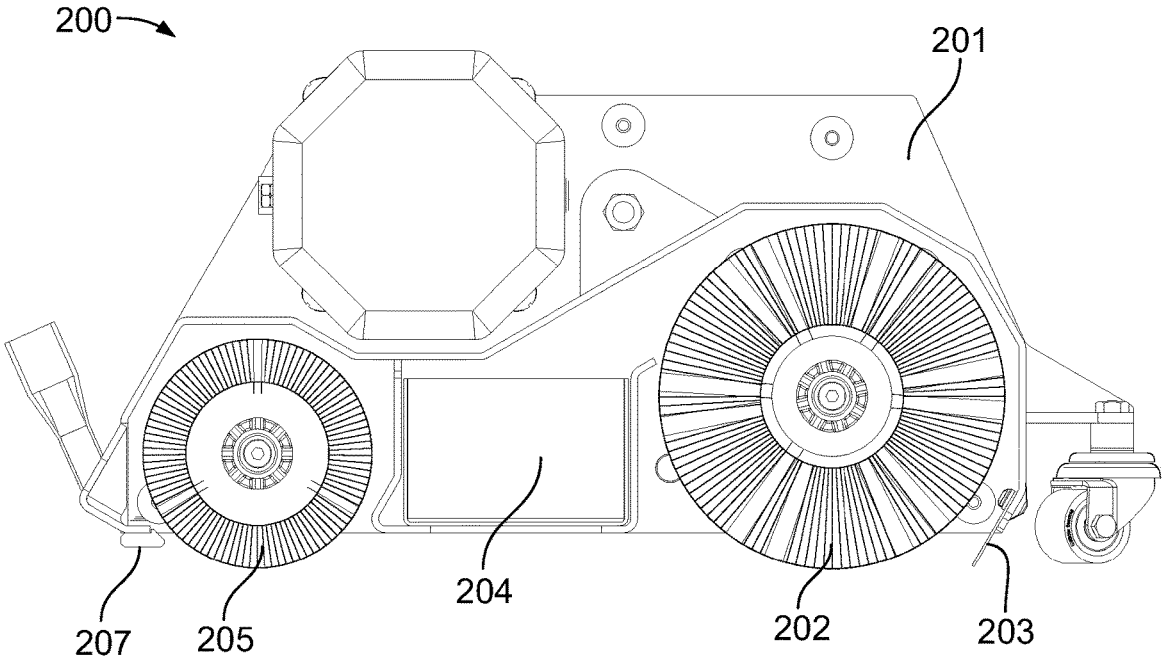
FIG. 2A, FIG. 2B, FIG. 2C, FIG. 2D, FIG. 2E and FIG. 2F illustrate an embodiment of a vacuum and sweeper brush both configured into one cleaning head.
Figure 2B:
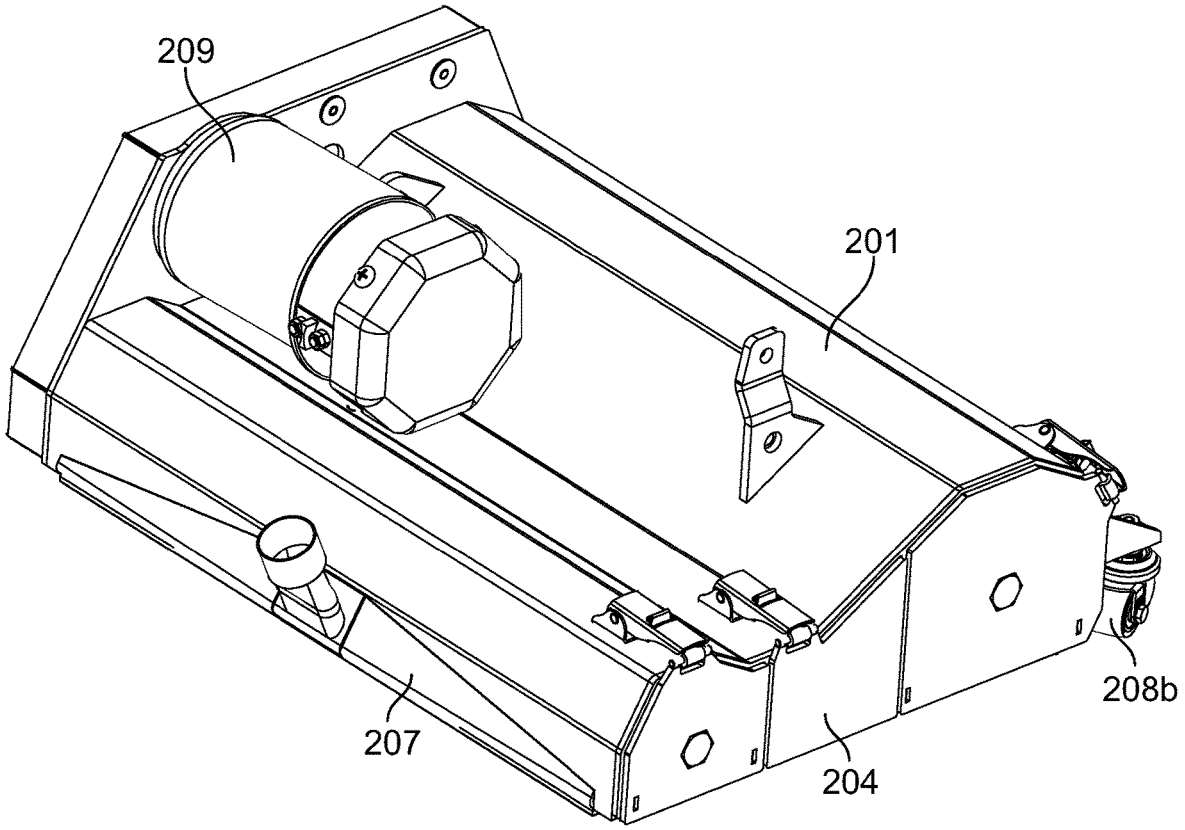
Figure 2C:
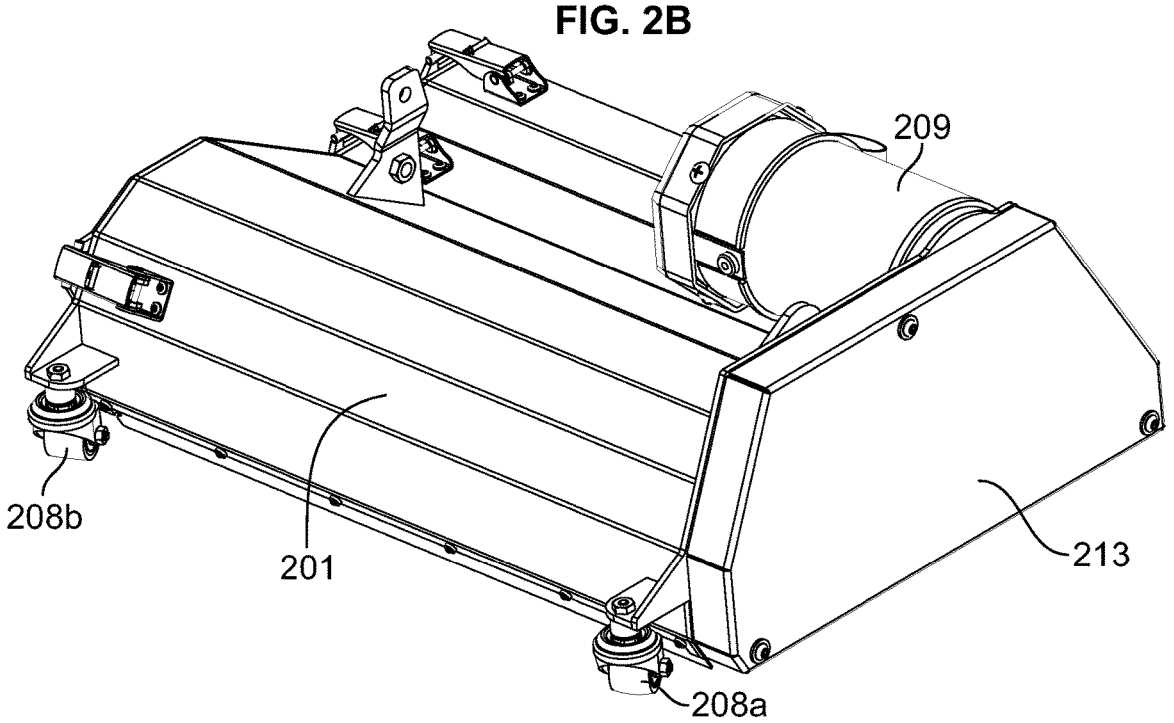
Figure 2D:
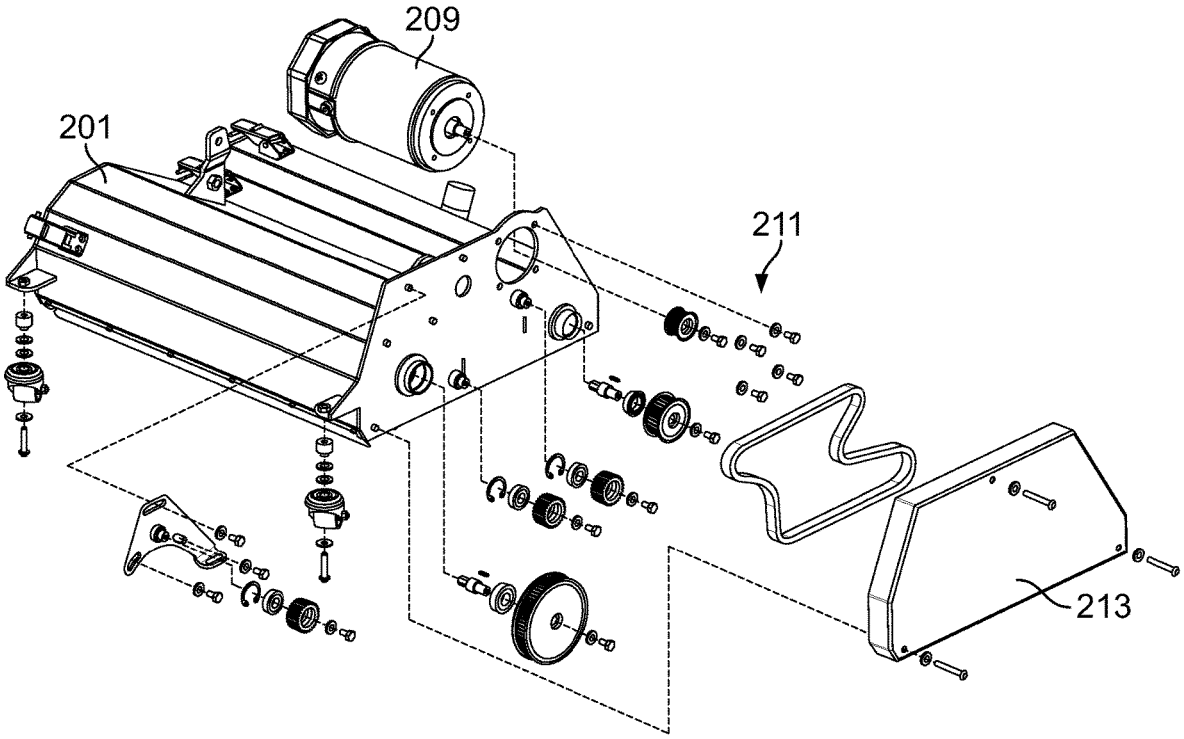
Figure 2E:
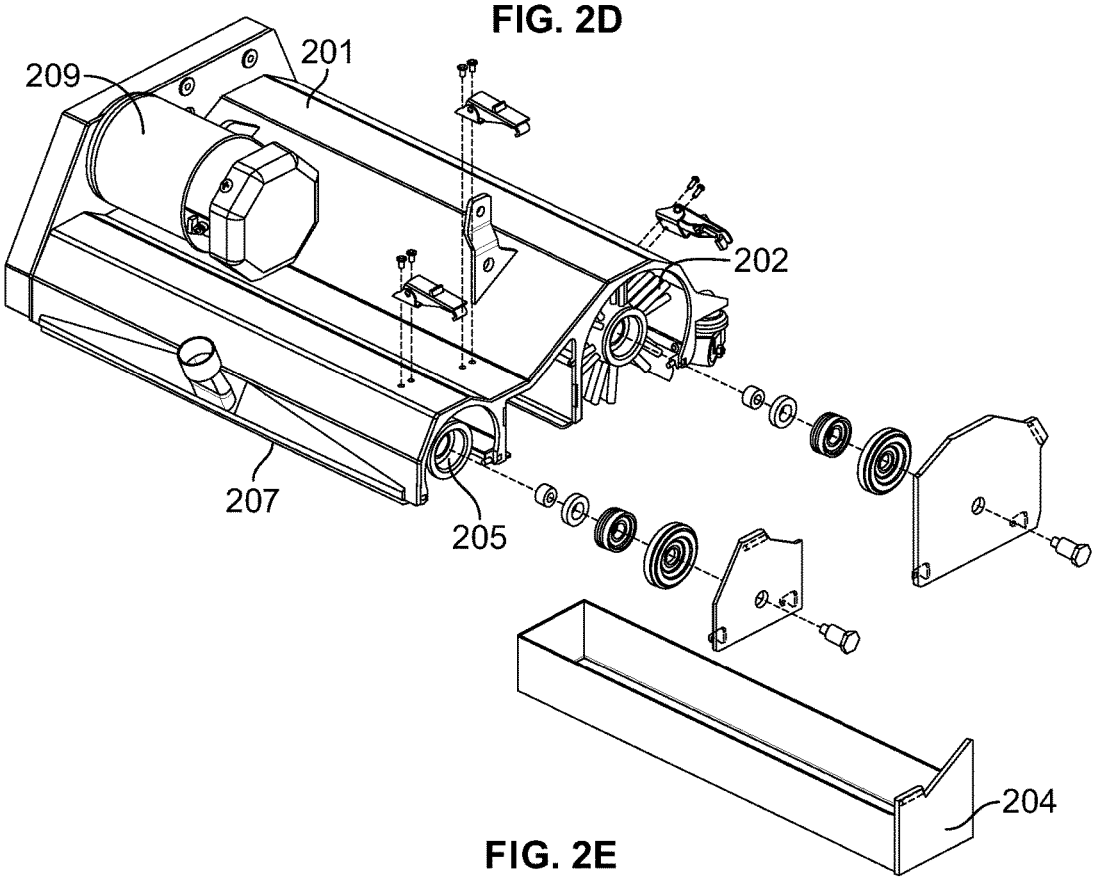
Figure 2F:
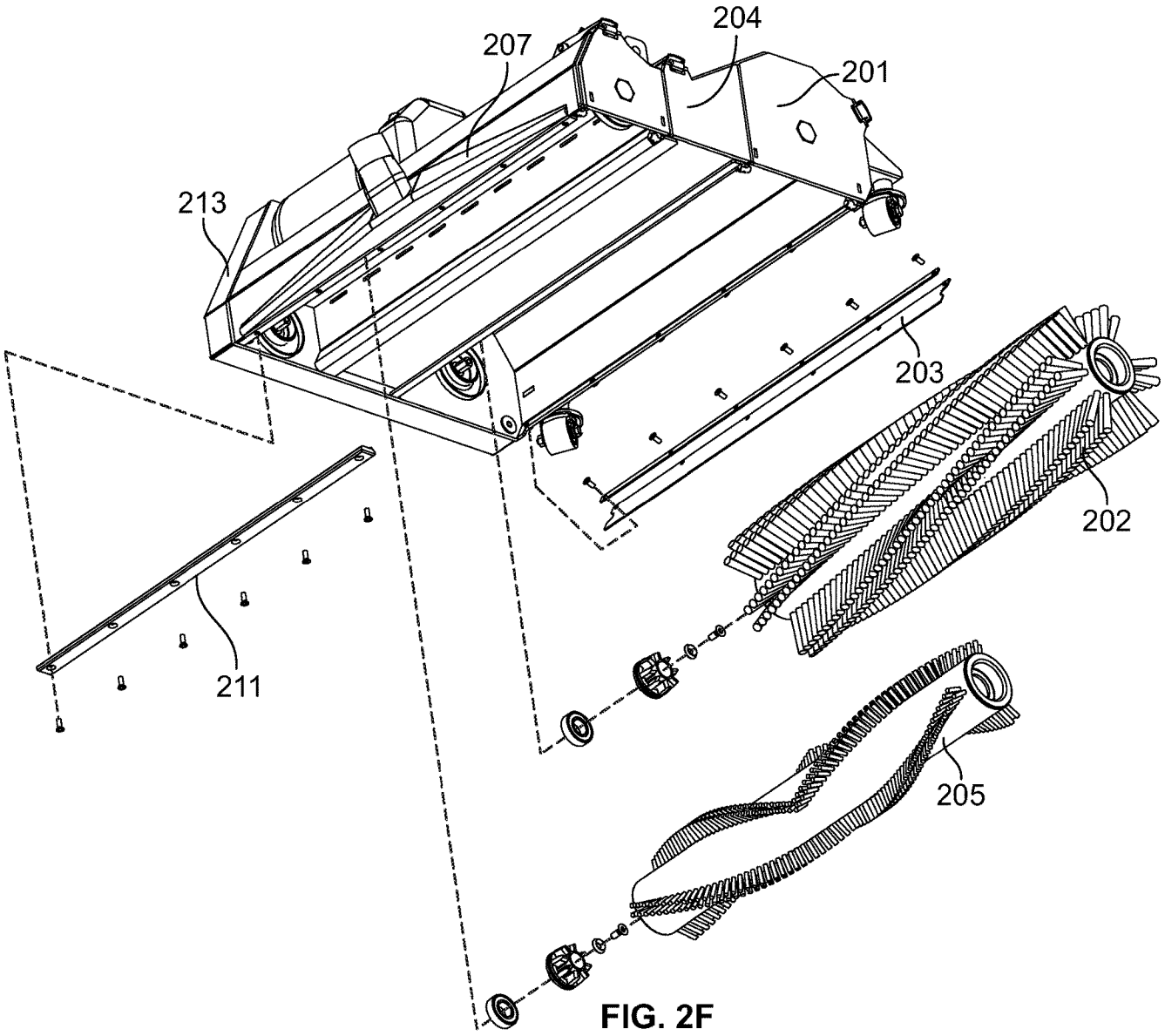

With regard to FIG. 2D, the front brush 202 and rear brush 205 are both driven using a motor 209 along with a plurality of gears or sheaves/pulleys forming drive system 211. The drive system 211 is configured under a cover 213 and enables the electric motor 209 to drive both brushes simultaneously.

Figure 3:
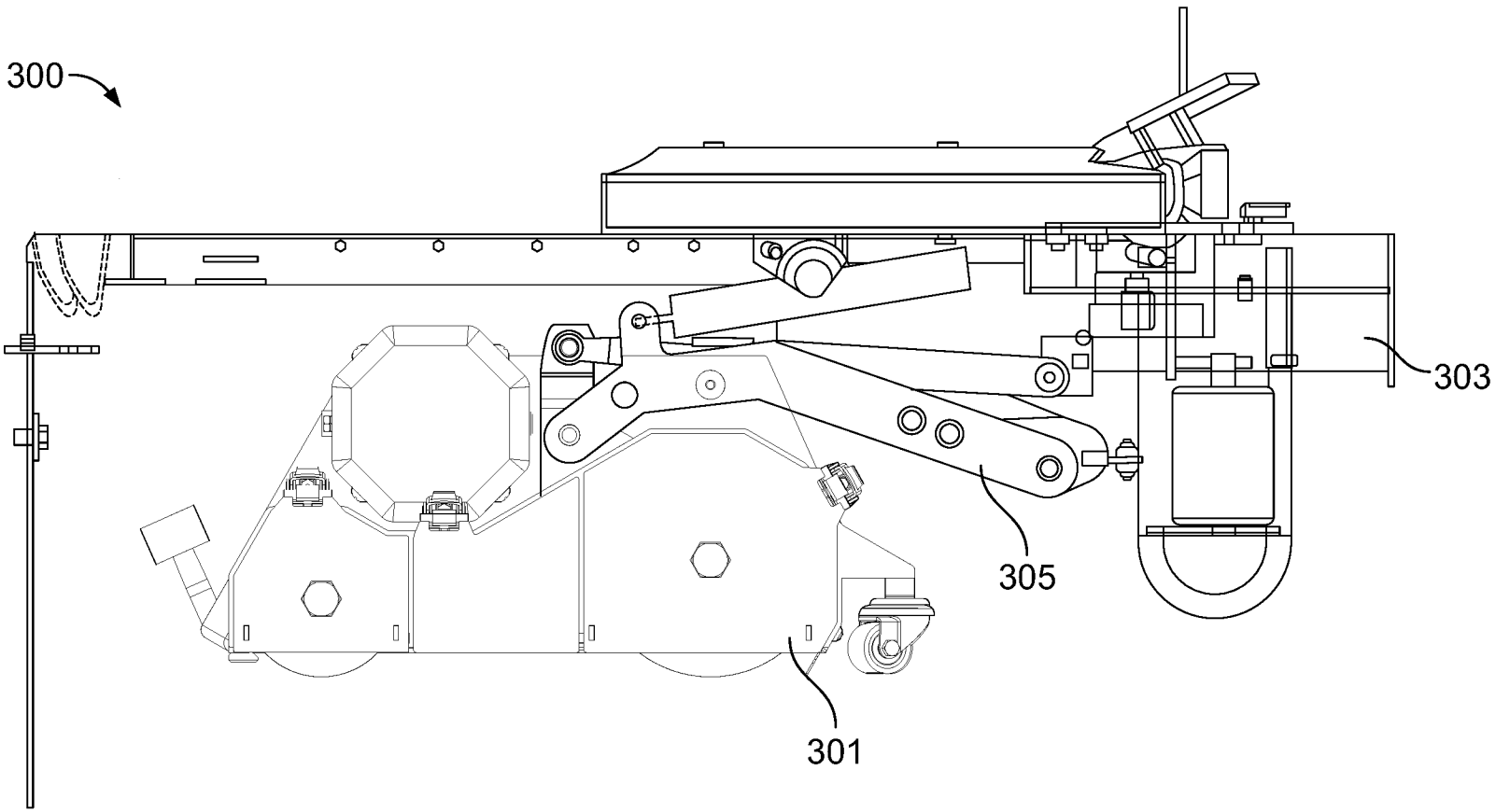
FIG. 3 illustrates the head shown in FIG. 2A where the head is mounted via an adjustable head leveling mechanism. illustrates the head shown in FIG. 2 where the head is mounted via an adjustable head leveling mechanism.

FIG. 3 illustrates a mounting system 300 where the head 301 it is mounted via an adjustable floor leveling mechanism 303. The down pressure of the head is controlled with a horizontally mounted spring system 305. The floor leveling mechanism 303 may use a spring or other biasing device and offers an advantage in that it reduces sweeper brush pressure with the floor so that the motor and brushes are not overloaded on uneven floor surfaces.

2. Skid/Caster—Sets Brush Engagement with Floor

Figure 4:
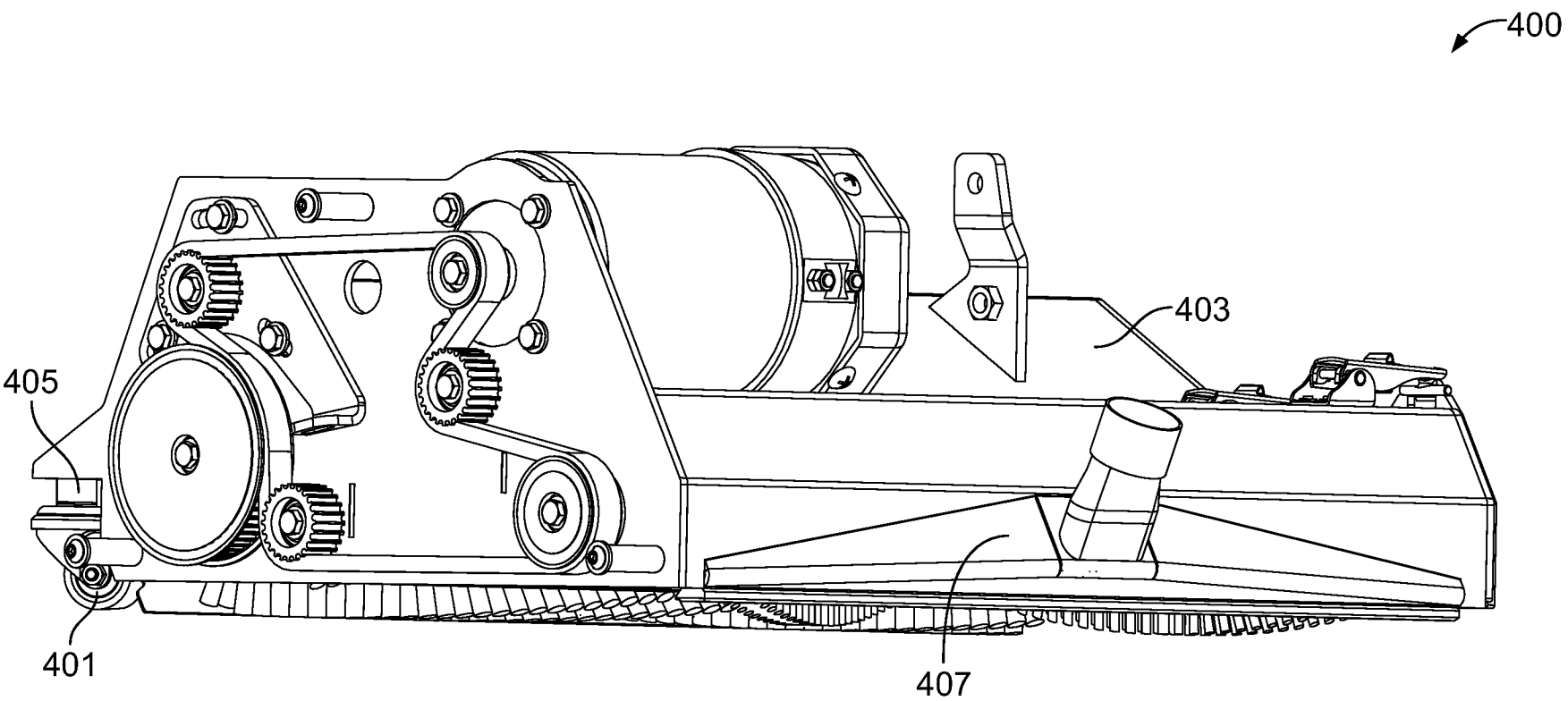
FIG. 4 illustrates the vacuum shoe that has been integrated into the head and the front casters that maintain appropriate brush/floor engagement
Figure 5:
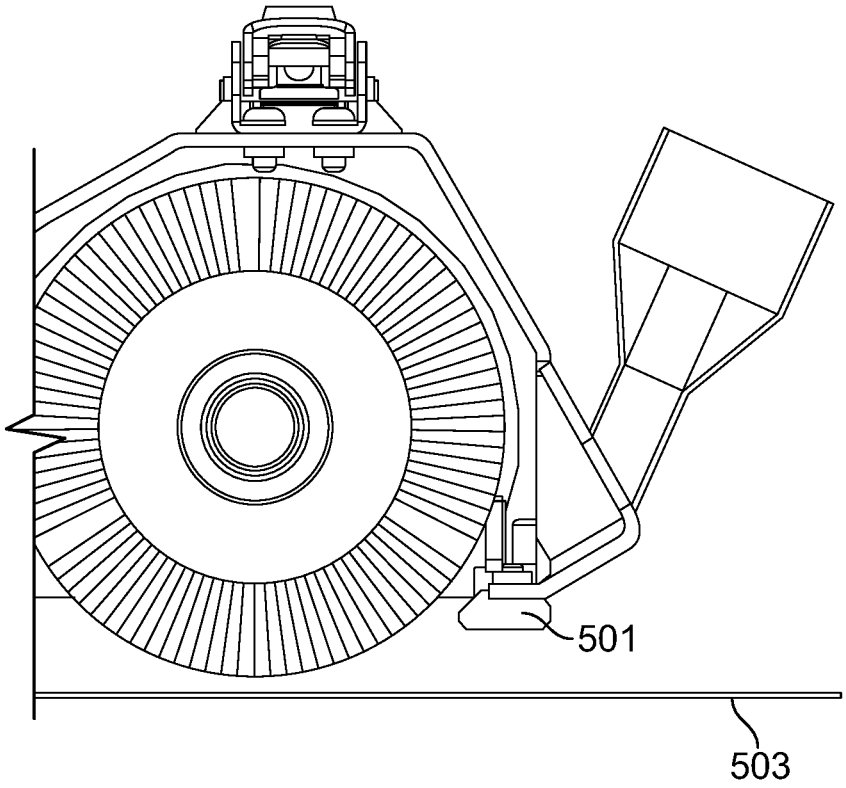
FIG. 5 illustrates guide skids attached to the cleaning head for controlling height.

FIG. 4 illustrates the guide skids attachment system 400 as used with the sweeper/vacuum head where the rear vacuum shoe 407 is incorporated into the head 403. A plurality of guide skids 401 prevent the head 403 from contacting the floor while acting as a skid to set the height of the head 403. Those skilled in the art will recognize that the guide skid 401 may be a wheeled roller that helps to prevent the head contacting the floor. In one embodiment, a spring-loaded slide 405 allows the vacuum shoe 407 to float and adjust itself vertically in an upward manner if it comes in contact with obstructions on the floor surface. FIG. 7 also illustrates wheeled casters used in connection with the head. FIG. 5 illustrates the vertical adjustment of the head above the floor surface. More specifically, FIG. 5 illustrates a skid/guide plate 501 riding above the floor surface 503. Those skilled in the art will recognize that the skid/guide plate 501 may contact—the floor 503 in the event of an obstruction in front of the moving head to prevent damage to the floor or head. The guide roller may be adjustable and may optionally may be spring loaded to allow the head to bounce and adjust when coming into contact with an object.

3. Single Motor Drive—2-Sided Belt

Figure 6A:
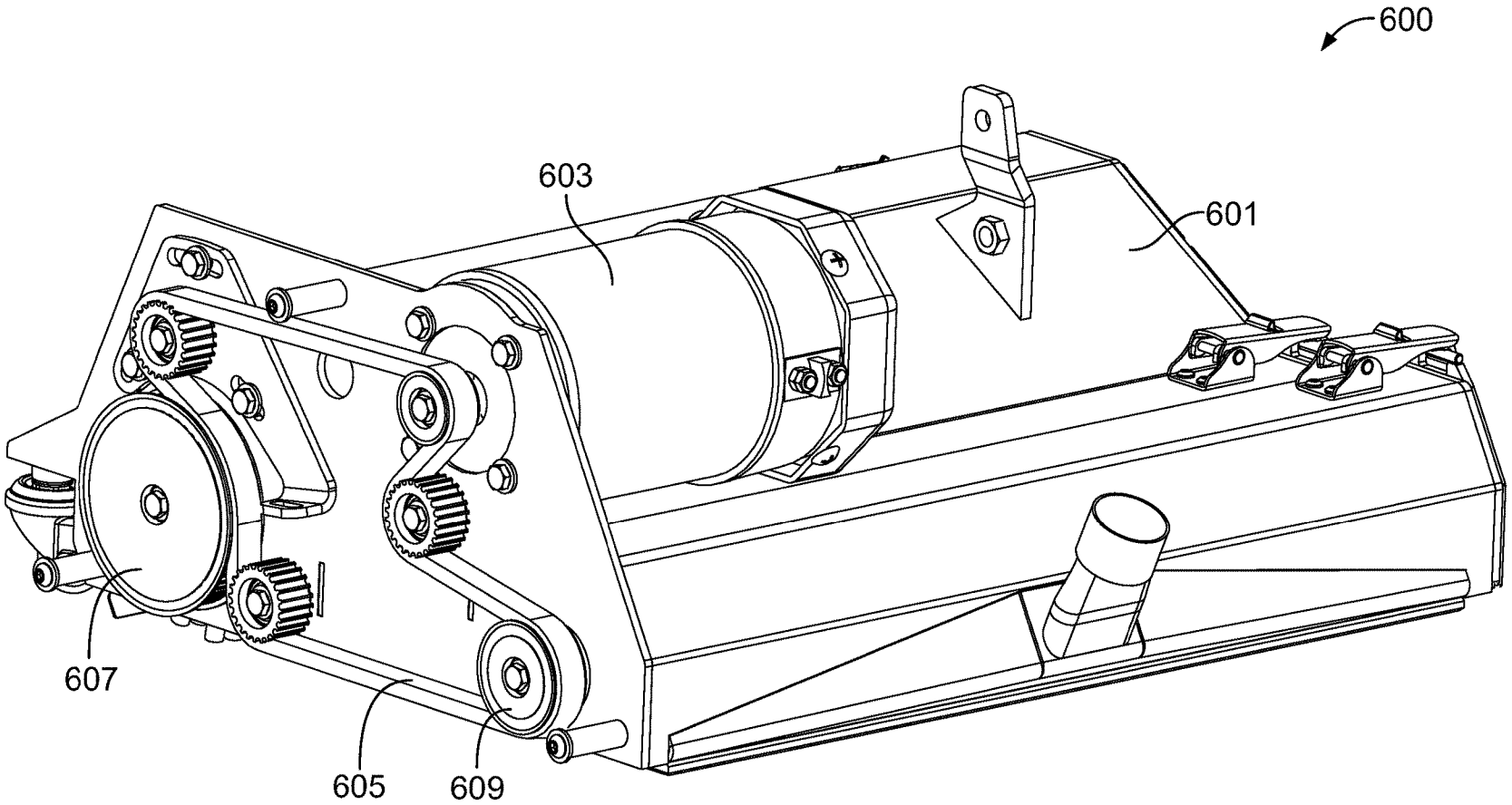
FIG. 6A is a perspective views of the brush drive assembly as used in the head showing a single motor drive system.

FIG. 6A is a perspective view illustrating the drive system 600 as used in the head 601. The drive system 600 uses a single motor 603 and a double-sided drive belt 605 to rotate the sweeper brush 607 and vacuum brush 609.

Figure 6B:
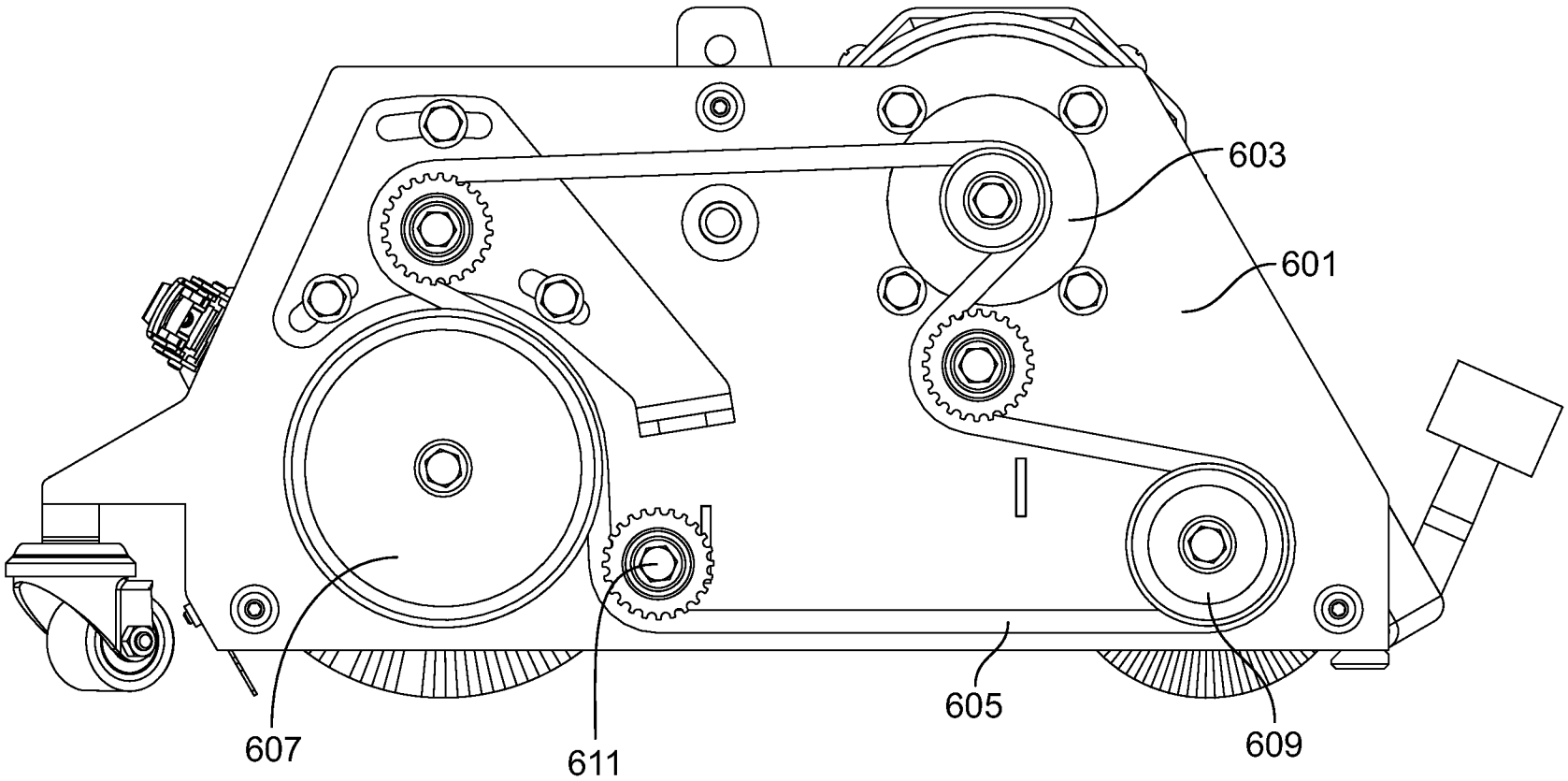
FIG. 6B is a side-cross-sectional view illustrating the single motor drive system.

FIG. 6B illustrates a cross-sectional view of the head 601 where the single motor drive assembly works to drive both the sweeper brush 607 and the vacuum brush 609 using a plurality of pulleys 611. The motor drive assembly includes a belt 605 with teeth on both side of the belt 605. The belt 605 is shown driven by the motor around cogged pulleys 611 enabling it to operate, rotate and drive both brushes in the drive assembly.

4. Dust Management—Holes in Top Tray Chamber

Figure 7A:
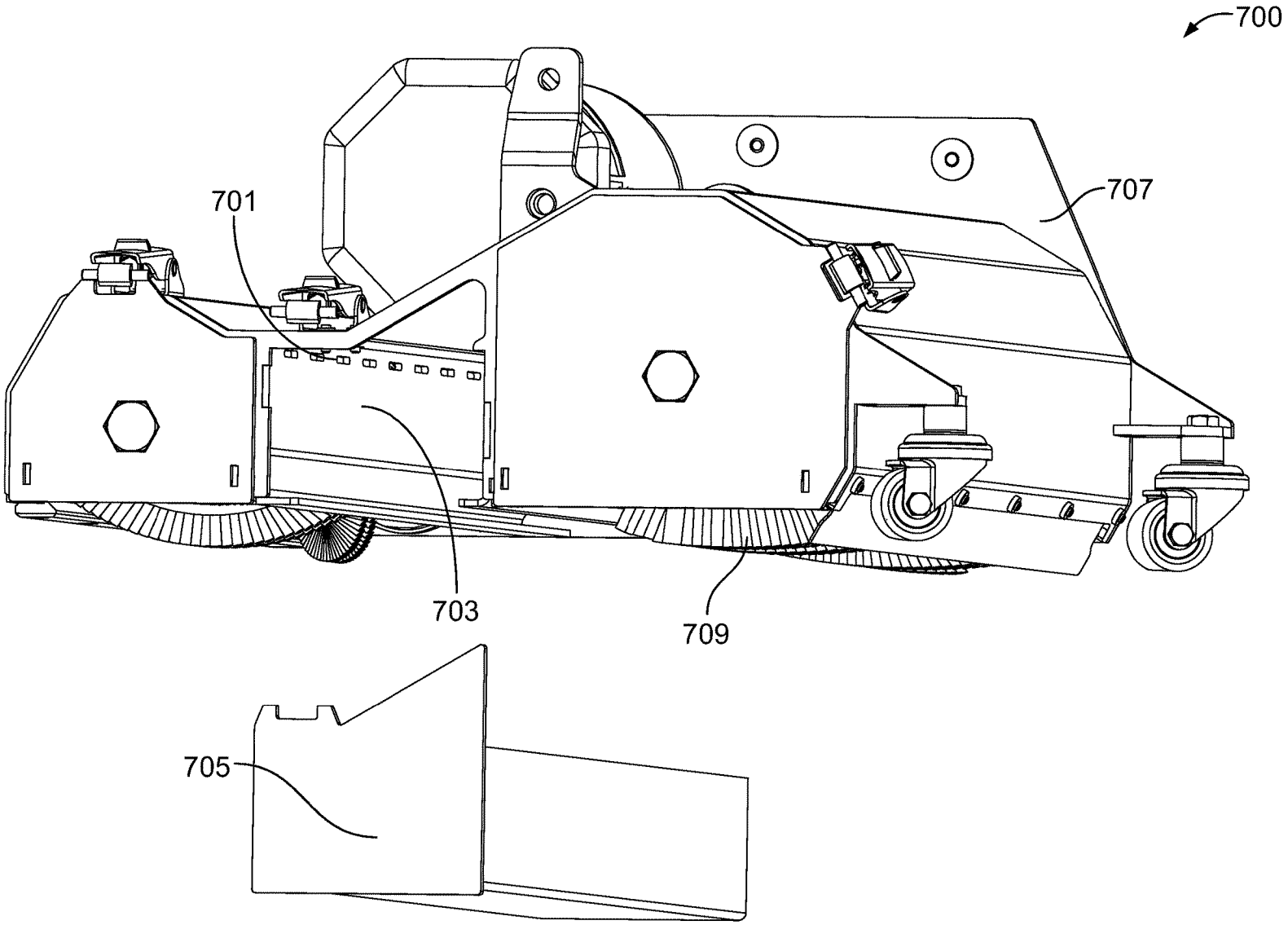
FIG. 7A and FIG. 7B are side perspectives views illustrating holes in the top portion of the debris tray as used for dust control.
Figure 7B:
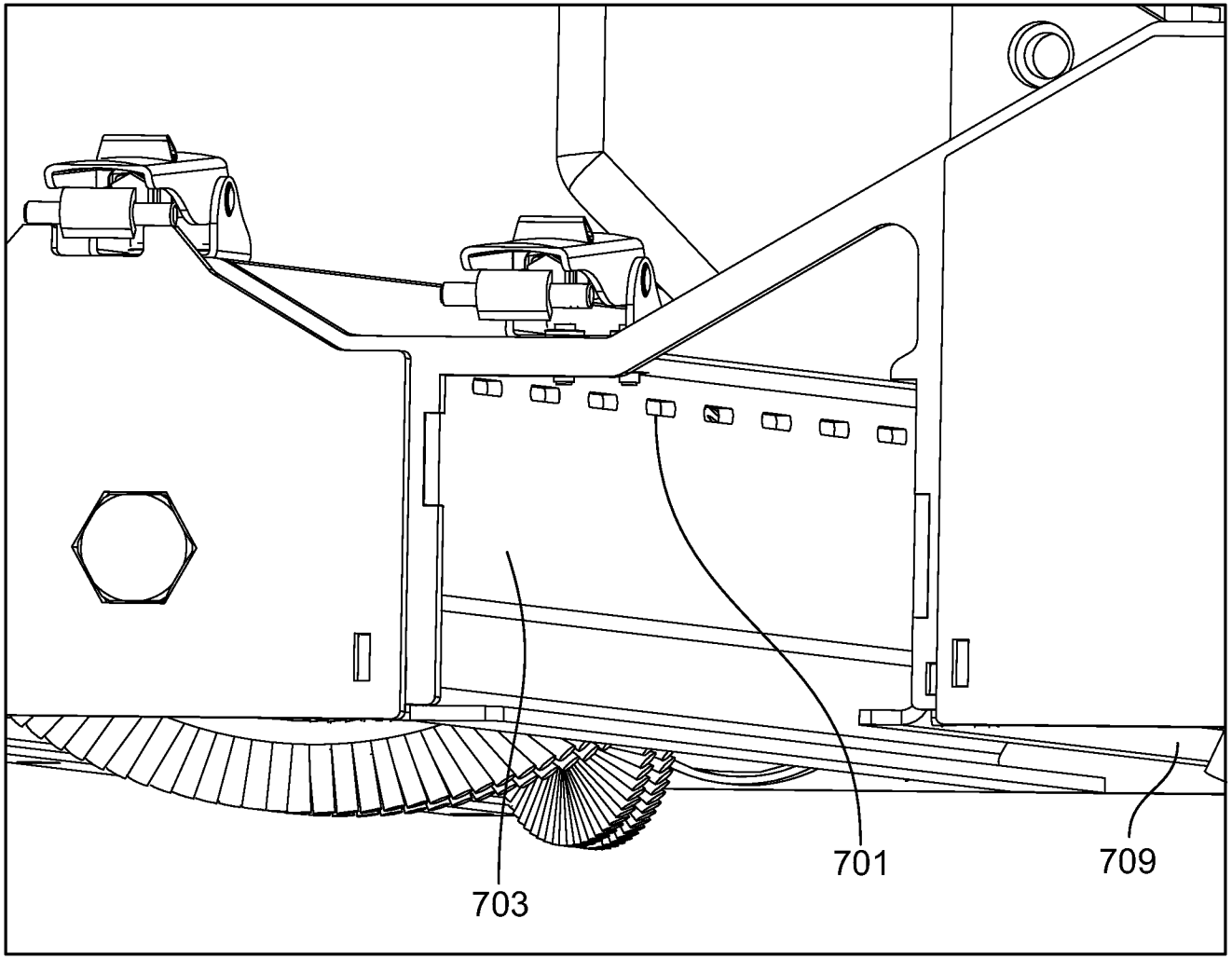

FIG. 7A and FIG. 7B are side perspectives views of a dust control system 700 illustrating holes 701 in the top portion of the debris tray chamber 703. More specifically, FIG. 7A shows the debris tray 705 shown removed from the head 707. The debris tray 705 works to collect and retain dirt and other larger scale debris that is collected by the rotating sweeper brush 709. As seen in both FIGS. 7A and 7B, a plurality of vent holes 703 in the top portion of the tray chamber 703 allow a negative pressure to be formed in the tray 705 so that the dirt and dust that is swept into the tray is drawn though the holes 701 and into the adjacent vacuum system. Thus, dust can more easily be controlled instead of escaping into the atmosphere.

5. Pivoting and Removeable Door for Covering Brushes

Figure 8A:
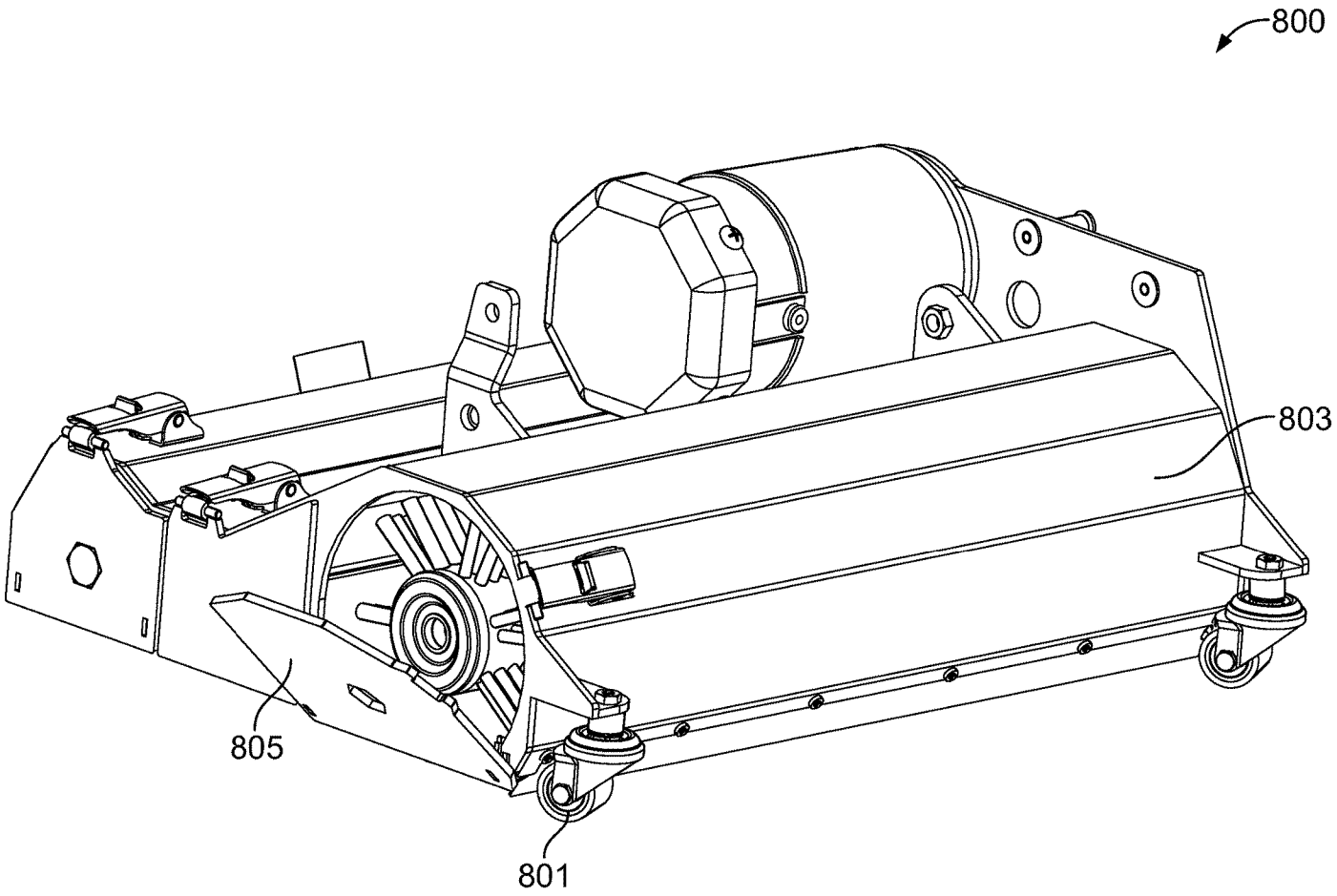
FIG. 8A and FIG. 8B are side perspective views of a pivoting brush doors for removing the sweeper and vacuum brush respectively from the head.
Figure 8B:
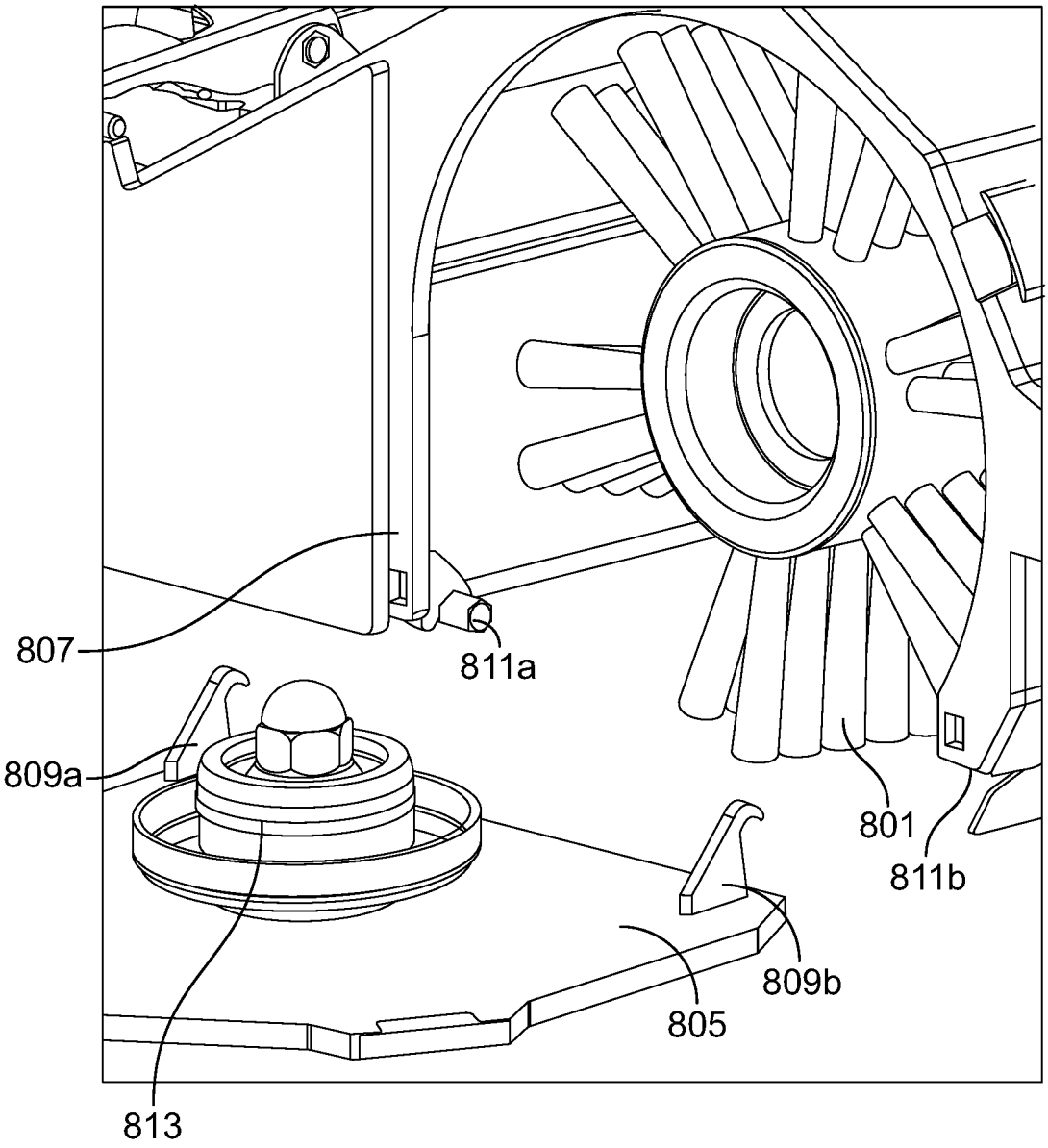

FIG. 8A and FIG. 8B are side perspective views of a pivoting brush door assembly 800 used for removing the sweeper and/or vacuum brushes 801 from the head 803. More specifically, the brush door 805 pivots from a lower portion 807 of the housing so to open the area at the side of the head allowing the brush 801 to be removed from the head 803. As seen in FIG. 8B, the door 805 includes a plurality of tabs 809*a*, 809*b* that pivot about a point e.g. using a plurality of cylindrical rods 811*a*, 811*b* attached at each side of the door opening. The tabs 809*a*, 809*b* ride on top of the rod allowing the door 805 to rotate about the rods 811*a*, 811*b*. Those skilled in the art will recognize that although cylindrical rods are shown, any mechanical fastener allowing the door to pivot can be used. One or more rectangular retaining catch(s) are formed using an aperture or hole with the catch that works to hold the door 805 to the head 803 to cover the door opening. A guide bushing 813 is attached to the inside of the door 805 that supports the brush 801 allowing it to rotate freely when the door is in position. Additionally, the pivoting brush door can also be completely removed from the head in order to gain full access to the brushes behind the door. With the door removed, the brush is much more easily accessed, installed and/or removed from the head.

6. Vacuum Bag Cage

Figure 9:
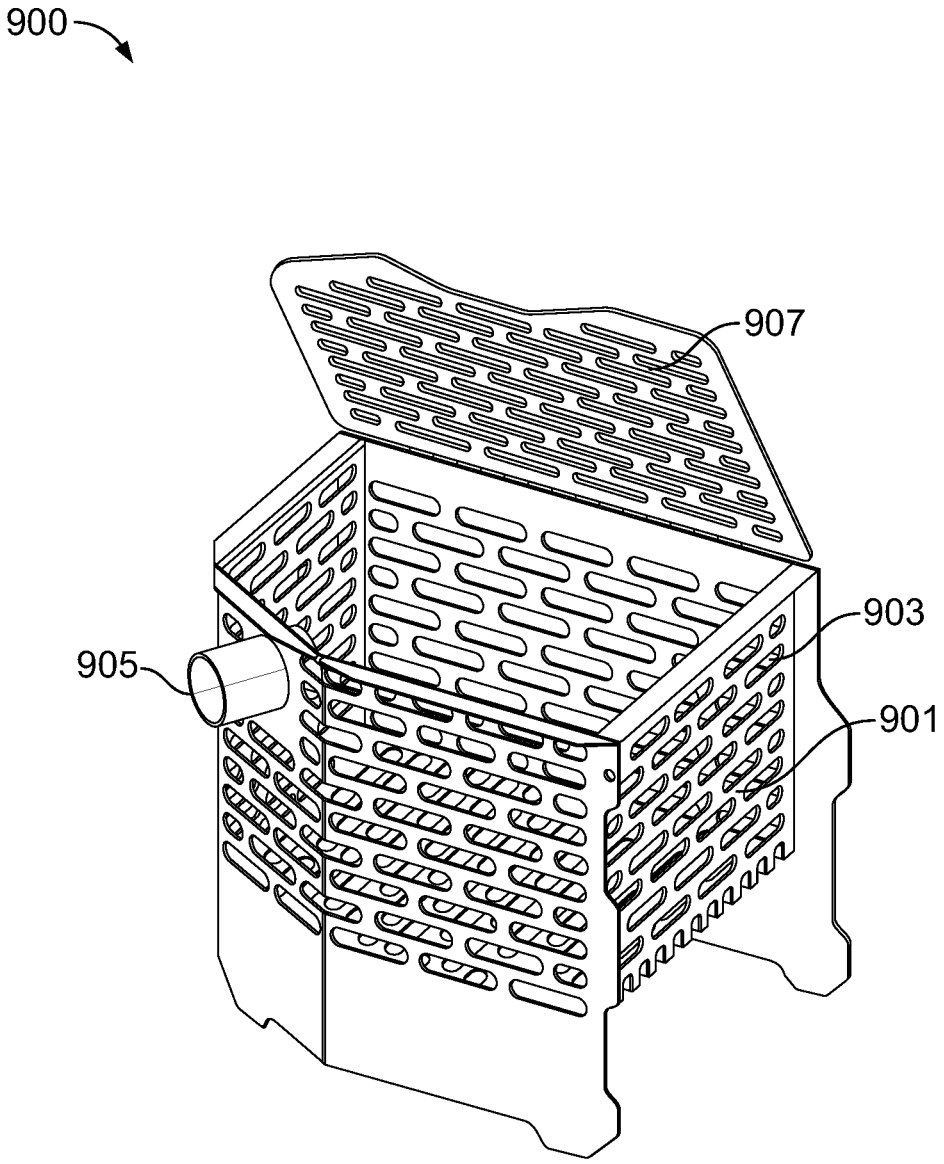
FIG. 9 is a side perspective view of a bag cage for holding the vacuum bag into a fixed position.

FIG. 9 is a side perspective view of a bag cage for holding a vacuum bag into a fixed position. The bag cage 900 is substantially square in shape and includes a plurality of supporting surfaces with apertures or holes 903 in each surface. When a vacuum bag in inserted in the bag cage, dirt and other debris is sucked into the vacuum bag and the holes in the bag cage allow air filtered air from the bag to be directed to areas in the sphere of operation of the vacuum system. Since air can escape from any side or surface of the bag, this increases suction and overall efficiency the vacuum system as opposed to a fully contained bag. The bag cage 900 includes an inlet 905 and a hinged lid 907 for bag installation and removal.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A sweeper/vacuum head comprising;

a housing;

a first rotating brush for picking up substantially large debris in the direction of motion in front of the housing;

a second rotating brush located behind the first rotating brush for agitating substantially small debris;

a debris tray for collecting the substantially large debris swept by the first rotating brush;

a vacuum shoe located behind the second rotating brush for providing suction for the substantially small debris; and wherein the first rotating brush and the second rotating brush are consolidated in one cleaning head.

2. A sweep/vacuum head as in claim 1, wherein the first rotating brush and second rotating brush rotate in opposite directions.

3. A sweep/vacuum head as in claim 1, wherein the first rotating brush is larger in diameter then the second rotating brush.

4. A sweep/vacuum head as in claim 1, wherein the debris tray is located between the first rotating brush and second rotating brush.

5. A sweep/vacuum head as in claim 1, further comprising:

an electric motor for providing rotational motion to both the first rotating brush and second rotating brush.

6. A sweep/vacuum head as in claim 1, wherein the electric motor is located outside the housing.

7. A sweep/vacuum head as in claim 1, wherein the sweep/vacuum head is supported on the floor by a plurality of casters.

8. A sweep/vacuum head as in claim 1, wherein the sweeper/vacuum head is used in a ride-on cleaning system.

9. A sweep/vacuum head comprising:

a housing forming a dome shape;

a first rotating brush for directing substantially large debris in front of the housing in the direction of motion into a debris tray;

a second rotating brush, rotating in a direction opposite that of the first rotating brush, for directing substantially small debris and dust under the housing to a vacuum shoe; and an electric motor for rotating both the first rotating brush and second rotating brush.

10. A sweep/vacuum head as in claim 9, wherein the first rotating brush is larger in diameter then the second rotating brush.

11. A sweep/vacuum head as in claim 9, wherein the debris tray is configured between the first rotating brush and second rotating brush.

12. A sweep/vacuum head as in claim 9, wherein the housing forms a dome-like shape.

13. A sweep/vacuum head as in claim 9, wherein the motor is configured outside the housing.

14. A sweep/vacuum head as in claim 9, where the sweep/vacuum head is used with a ride-on cleaning system.

15. A sweep/vacuum head for use with a for use with a ride-on cleaning system comprising;

a housing configured at the floor under the ride-on cleaning system;

a first brush rotating in a first direction;

a second brush rotating in a second direction opposite that of the first direction;

a debris tray located between the first brush and second brush for collecting substantially large debris agitated from the first brush;

a vacuum shoe configured behind the second brush for collecting dust and substantially small debris agitated by the second brush;

a motor for rotating both the first brush and second brush; and at least on caster for supporting the housing's motion while moving across the floor.

16. A sweep/vacuum head as in claim 15, wherein the first brush is larger in diameter than the second brush.

17. A sweep/vacuum head as in claim 15, wherein the motor is located outside the housing.

18. A sweep/vacuum head as in claim 15, wherein the first brush and second brush as substantially cylindrical in shape.

19. A sweep/vacuum head as in claim 15, wherein the vacuum shoe directs the dust and substantially small debris into a vacuum cage on the ride-on cleaning system.

* * * * *